United States Patent [19]

Torii

[11] 4,361,172

[45] Nov. 30, 1982

[54] MECHANISM FOR STOPPING A CIRCULAR LOOM DURING WEAVING OPERATION

[75] Inventor: Soichi Torii, Kyoto, Japan

[73] Assignee: Torii Winding Machine Co., Ltd., Kyoto, Japan

[21] Appl. No.: 201,068

[22] PCT Filed: Aug. 24, 1979

[86] PCT No.: PCT/JP79/00225

§ 371 Date: Apr. 25, 1980

§ 102(e) Date: Apr. 14, 1980

[87] PCT Pub. No.: WO80/00459

PCT Pub. Date: Mar. 20, 1980

[30] Foreign Application Priority Data

Aug. 25, 1978 [JP] Japan ..... 53-116964
Aug. 25, 1978 [JP] Japan ..... 53-116965

[51] Int. Cl.[3] ..... D03D 51/40
[52] U.S. Cl. ..... 139/371
[58] Field of Search ..... 139/13 R, 13 A, 371

[56] References Cited

U.S. PATENT DOCUMENTS 2,655,184 10/1953 Depoilly ..... 139/371

FOREIGN PATENT DOCUMENTS 7-13185 3/1932 Japan .
7-2311 6/1932 Japan .
7-2988 7/1932 Japan .
465529 12/1968 Switzerland ..... 139/371
1247360 9/1971 United Kingdom ..... 139/371
1348498 3/1974 United Kingdom ..... 139/371

*Primary Examiner*—Henry Jaudon
*Attorney, Agent, or Firm*—Burgess, Ryan and Wayne

[57] ABSTRACT

In a circular loom provided with a motor for driving the loom, and annular guide means for guiding at least one shuttle along the annular guide, when a weft is broken or a yarn package formed on a bobbin held by a shuttle is exhausted, the driving of the circular loom is automatically stopped by a mechanism comprising a first detector for detecting a weft breakage, and/or a second detector for detecting an exhaustion of a yarn package, means for stopping an electric power from a power source to said motor, means for transmitting a signal from said first detector and/or said second detector to said stopping means.

The above-mentioned first detector and second detector are mounted on each shuttle.

4 Claims, 9 Drawing Figures

MECHANISM FOR STOPPING A CIRCULAR LOOM DURING WEAVING OPERATION

BACKGROUND OF THE INVENTION

1. Field of the Invention

The present invention relates to a circular loom for producing a tubular woven fabric and, more particularly, to a mechanism for stopping the driving of the circular loom in accordance with a signal issued from a mechanism for detecting an abnormal condition of a weft taken out from a shuttle in the circular loom. The mechanism for automatically stopping a circular loom due to an abnormal condition of a weft taken out from a yarn package formed on a bobbin held by a shuttle during the weaving operation is hereinafter referred to as the mechanism for stopping a circular loom during the weaving operation thereof.

2. Description of the Prior Art

In a circular loom, a shuttle is moved along a circular running passage, and a weft taken out from the shuttle is inserted into successive sheds created in advance of the arrival of the shuttle, and the weft is interwoven with warps to form a tubular woven fabric. However, the conventional circular loom of this type includes a serious problem. Namely, when the weft is broken or a yarn package formed on a bobbin held by a shuttle is exhausted, the weft insertion into the successive sheds is interrupted, even though the shuttle travels along the circular running passage formed in the circular loom. Therefore, such an interruption of the weft-insertion into the successive sheds creates a portion of tubular fabric without weft and, consequently, it has been necessary to have a machine operator continuously watch the weaving operation. In other words, the possibility of the occurrence of the above-mentioned problem prevents the rationalization of the production of tubular woven fabric by circular looms, which rationalization includes the reduction of the number of machine operators and production costs.

To eliminate the above-mentioned problem, several proposals for detecting weft-breakage or exhaustion of a yarn package formed on a bobbin held by a shuttle, during the weaving operation of a circular loom, have recently been put into practice. For example, in the circular loom manufactured by Starlinger & Co., Austria, a photo-electric device for detecting the exhaustion of the yarn package formed on a bobbin held by a shuttle is utilized. This device is mounted on the circular loom and comprises a light emitting device which emits a light beam directed to the passage of the shuttle, and a photocell for receiving a possible reflection from the surface of a bobbin, from which a weft has been exhausted. In another example, in the circular loom manufactured by ED Ferreirinna & Irmao, Portugal, a photoelectric device like the device utilized for the circular loom manufactured by Starlinger & Co., is applied. To detect weft breakdown during the weaving operation, a mechanical sensor to detect a weft break-down is mounted on a device for propelling a shuttle, and this mechanical sensor is capable of detecting a condition that a weft is not inserted into the successive sheds formed in the circular loom, and; when this mechanical sensor detects a weft break-down, an electric signal due to the detection by this sensor is transmitted to an actuator to operate a stop motion mechanism of the circular loom.

Based on the experience of the invention of the present invention, as well as research they conducted on the mechanisms of the above-mentioned devices, it has been determined that the mechanisms of the above mentioned devices are complicated, the working functions thereof are not stable and the reliability thereof is uncertain.

Therefore, it is the main object of the present invention to provide a practical mechanism for stopping a circular loom during the weaving operation when a detector detects a weft breakage or an exhaustion of a yarn package formed on a bobbin held by a shuttle, so as to eliminate the above-mentioned serious problem caused by the above-mentioned abnormal condition of weft taken from a yarn package formed on a bobbin held by a shuttle.

SUMMARY OF THE INVENTION

The mechanism for automatically stopping the circular loom according to the present invention comprises means for detecting an abnormal condition or trouble of a weft taken out from a bobbin mounted on a shuttle, means for stopping the supply of electric power to driving motor of the circular loom and means for transmitting a signal issued from the above-mentioned detecting means to said stopping means.

In the above-mentioned mechanism of the present invention, means for detecting a trouble due to a weft, such as the breakage or exhaustion of a weft from a yarn package formed on a bobbin held by a shuttle, is mounted on the shuttle, and; means for transmitting a signal issued from the above-mentioned detecting means is partly mounted on the shuttle and partly mounted on the circular loom so as to transmit the above-mentioned signal to an electrical mechanism for stopping the driving of the circular loom.

In the present invention, the above-mentioned detecting means is a first detector for detecting the exhaustion of the weft from a yarn package at a time in advance of the time when the tail end of the weft leaves a bobbin of the yarn package held in the shuttle. The above-mentioned first and second detectors are preferably mounted on the shuttle.

Since the above-mentioned problems regarding the weft are rapidly detected, so that the driving of the circular loom can be rapidly stopped in advance of the creation of a serious influence on the quality of the tubular fabric due to the above-mentioned problems, the present invention remarkably contributes to the improvement of the quality of tubular fabric produced by a circular loom. Moreover, since the circular loom can be automatically and rapidly stopped by utilizing the mechanism of the present invention at the time of the occurence of above-mentioned problems, the number of circular looms which can be operated by a single operator can be increased, so that the individual wages involved in the production cost can be reduced.

DETAILED EXPLANATION OF THE INVENTION

Figure 1:
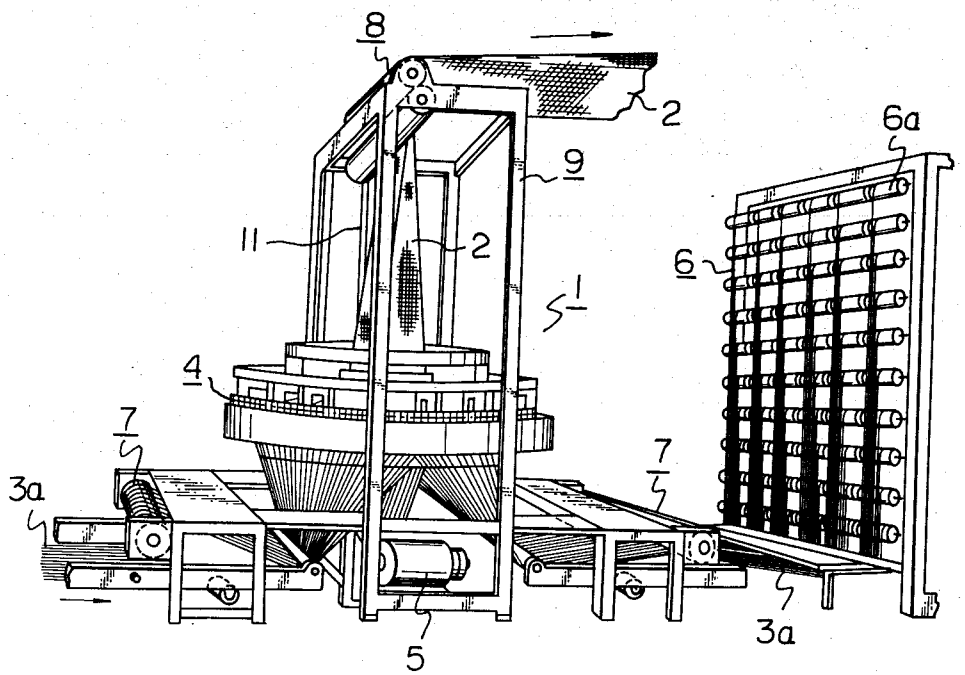
FIG. 1 is a schematic perspective view of a circular loom provided with the mechanism according to the present invention.

The mechanism for automatically stopping a circular loom during the weaving operation according to the present invention will now be explained in detail with reference to the preferred embodiments illustrated in the attached drawings.

For the purpose of clearly illustrating the present invention, an embodiment of a circular loom to which the mechanism of the present invention is applied will be described, with reference to FIGS. 1 through 3, prior to entering into the description of the structure and effect of the mechanism for automatically stopping a circular loom according to the present invention.

In the circular loom 1 illustrated in FIG. 1, a main part 4 including shed forming means and filling means is mounted within a frame 9, and the shed forming means and filling means are driven by an electric motor 5 disposed below the main part 4 through a first power transmission mechanism (not shown). Tubular fabric take-out means 8 mounted on the frame 9 above the main part 4 is driven by a second transmission mechanism (not shown) connected to the take-out means 8. Since this second power transmission mechanism is driven by the first power transmission mechanism through a driving transmission lever 11, the take-out means 8 is synchronously driven with the main part 4. Warps 3a, in a number necessary for weaving a desirable tubular fabric 2, are fed to a pair of creels 6 disposed on both the sides of the main part 4 symmetrically with each other with respect to the main part 4 (only one creel disposed on the right side is illustrated in FIG. 1), from a plurality of packages 6a mounted rotatably for feeding warps, and the warps 3 are fed to the main part 4 through warp feed-out means 7. The tubular fabric 2 formed by the weaving operation in the main part 4 of the circular loom 1 is upwardly taken out by the take-out means 8 and guided to winding means (not shown) in a direction indicated by an arrow.

Figure 2:
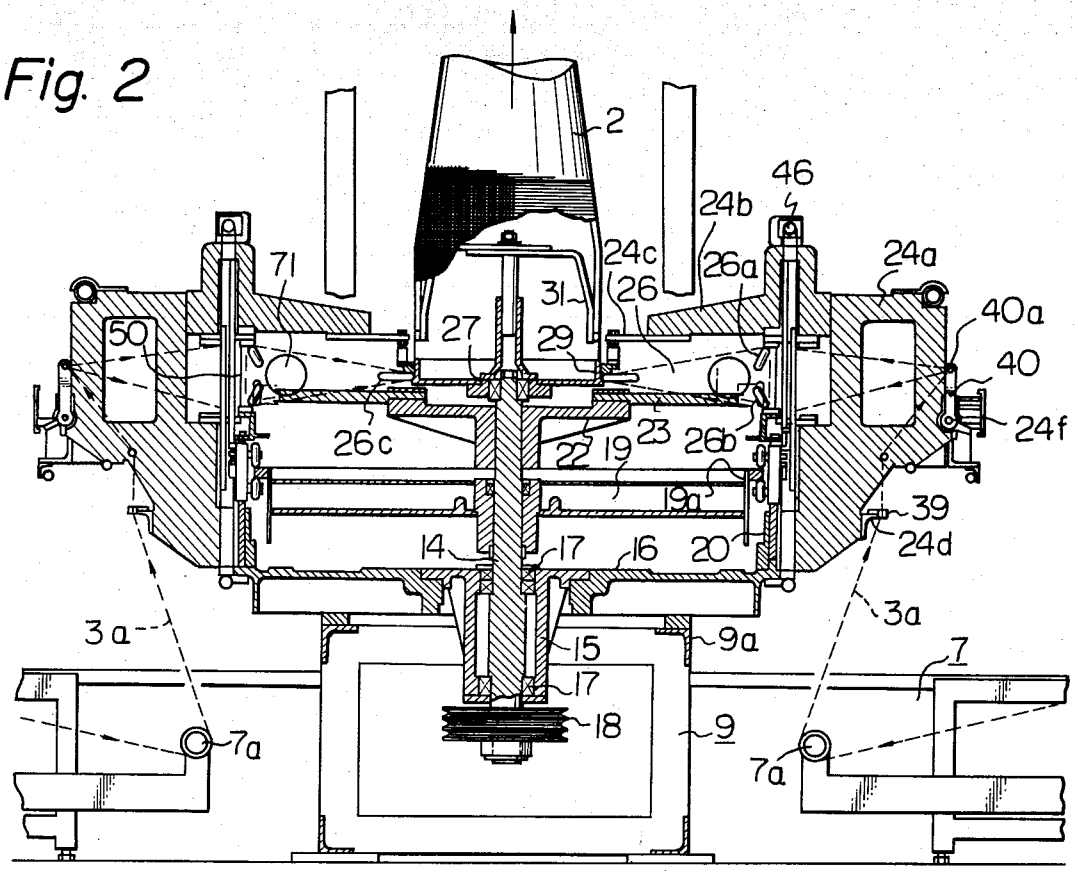
FIG. 2 is a schematic sectional view of a main part of the circular loom illustrated in FIG. 1.
Figure 3:
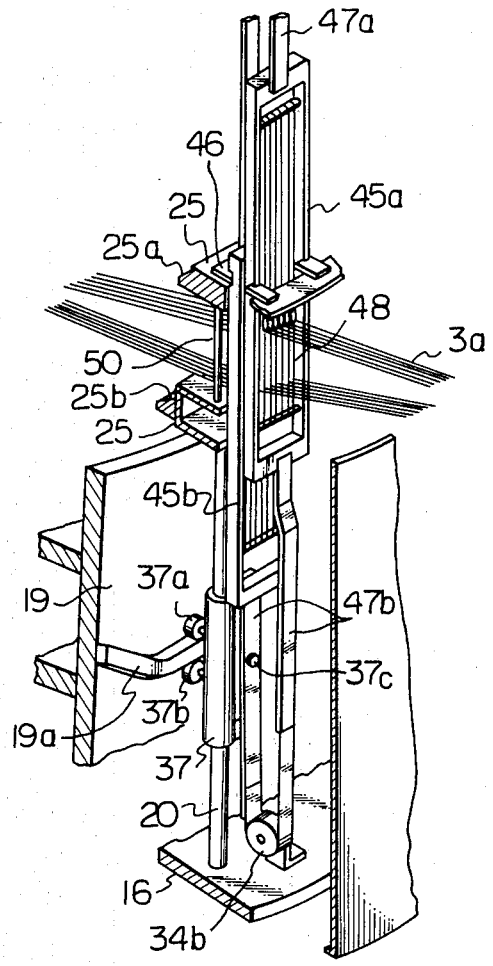
FIG. 3 is a schematic perspective view of a part of a shed forming mechanism of the circular loom illustrated in FIG. 1.

As shown in FIGS. 1, 2 and 3, the main part 4 of the circular loom 1 comprises a vertical shaft 14 rotatably supported through a pair of roll bearings 17 on bearings 15 fixed to a central opening of a disc-like frame 16 fixed to a base 9a of the frame 9; a grooved pulley 18 fixed to the lower end of the vertical shaft 14, a cylindrical cam mechanism 19 fixed to the shaft 14 at a position above the disc-like frame 16, a shed forming mechanism which is operated by an annular cam 19a of the cylindrical cam mechanism 19, four shuttle propelling mechanisms 23 fixed to a supporting member 22 fixed to the shaft 14 above the cylindrical cam mechanism 19; an annular guide means 25 comprising a pair of annular guide members 25a, 25b for guiding two pairs of front and rear wheels 26a and 26b mounted on both the sides of a shuttle 26; a horizontal disc guide member 27 supported rotatably on the top of the shaft 14 to guide another wheel 26c of the shuttle 26; an annular guide 29 which is stationarily held by supporting arms 24c, with a slight clearance from the top end of the annular edge of the horizontal disc guide member 27, so as to guide the tubular fabric 2; eight frame members 24a fixed to the disc-like frame 16; arms 24b fixed to every other one of the frame members 24a; a plurality of yarn guides 39 mounted on an annular member 24d fixed to the frame members 24a; a plurality of warp tension regulating dancing levers 40 pivoted to another annular member 24f having a circular section similarly fixed to the frames 24a. As shown in the drawings (FIGS. 1, 2 and 3), warps 3a are guided from the creels 6 through guide rolls 7a rotatably supported on frames 9b and the yarn guides 39 to yarn guide apertures 40a formed on the top end portion of the dancing lever 40, and a shed is formed by the shed forming mechanism, the structure of which is illustrated in detail in FIG. 3. The shuttle 26 propelled by the shuttle propelling mechanism 23 is inserted in this shed to weave the tubular fabric 2, and the tubular fabric 2 is taken out upwardly (in a direction indicated by an arrow) through an annular clearance formed between the circular edge of the horizontal guide member 27 and the annular guide 29, while being guided by a fabric guide member 31. Then, the tubular fabric 2 is wound on a roll through the take-out means 8 (FIG. 1) by winding means (not shown).

In the circular loom 1 having the above-mentioned structure, as shown in FIG. 3, the shed forming mechanism comprises: a plurality of vertical guide rods 20 fixed to the peripheral flange portion of the disc-like frame 16; a cam-follower holding member 37 slidably mounted on the respective guide rods 20; a cam 19a projected from the periphery of the cylindrical cam mechanism 19; a pair of cam-followers 37a and 37b, which are rotatably mounted on the holding member 37 so that they have rolling contact with the cam 19a from above and below the cam 19a, respectively; heald frame guides 46 mounted on the upper annular guide member 25a to guide a pair of heald frames 45a and 45b (heald frame guides are similarly mounted on the lower annular guide member 25b, but they are omitted in FIG. 3); belts 47a and 47b for connecting both the heald frames 45a and 45b to move the heald frames 45a and 45b vertically in opposite directions and, thus, form a fully open shed, and; a belt guide 34b mounted on the peripheral flange portion of the disc-like frame 16. Since the holding member 37 to which the cam-followers 37a and 37b are attached is connected to the belt 47b by a pin member 37c, a vertical movement is given to the heald frame 45a by the vertical movement of the holding member 37. This vertical movement is transmitted to the other heald frame 45b through the belts 47a and 47b. Accordingly, a vertical movement reversed to the vertical movement of the heald frame 45a is given to the heald frame 45b. The same number of heald wires 48 are held by each of the heald frames 45a and 45b, and vertical rods 50 in a number corresponding to the number of the heald wires 48 are fixedly arranged lengthwise in a space between the confronting horizontal planes of the upper and lower guide members 25*a* and 25*b* of the annular guide means 25. Since the shape of the cam face of the projection cam 19*a* is designed with respect of the heald frames 45*a* and 45*b* so that a fully open shed is formed when the warps 3 are passed through the eyes of the corresponding heald wires 48, respectively, a shed forming a plain weave structure can be produced by rotation of the cylindrical cam mechanism 19. Since plural pairs of the above-mentioned paired heald frames 45*a* and 45*b* are annularly arranged along the periphery of the cylindrical cam mechanism 19 adjacently to one another, these paired heald frames 45*a* and 45*b* are capable of creating successive sheds of identical shape with rotation of the cylindrical cam mechanism 19. Accordingly, if a plurality of shuttles 26, for example, four shuttles 26 are propelled by the respective shuttle propelling mechanisms 23 held by the supporting member 22, synchronously with formation of these sheds, a tubular fabric 2 of a plain weave structure can be formed.

The structure, functions and effects of the mechanism of the present invention for stopping the driving of the circular loom which is applied to the above-mentioned circular loom will now be described in detail.

As mentioned above, each shuttle 26 is propelled by means of the respective shuttle propelling mechanism so that each shuttle travels along a circular passage defined by the annular guide member 25. As already explained, when the shuttle 26 travels along a circular passage, the wheels 26*a*, 26*b* of the shuttle 26 roll on the corresponding annular guide members 25*a*, 25*b*, respectively, while the wheel 26*c* of the shuttle 26 rolls on the horizontal disc guide member 27.

Each shuttle 26 is provided with an identical structure and function, and therefore, the structure and function of only one of shuttles 26 is hereinafter explained.

Figure 4:
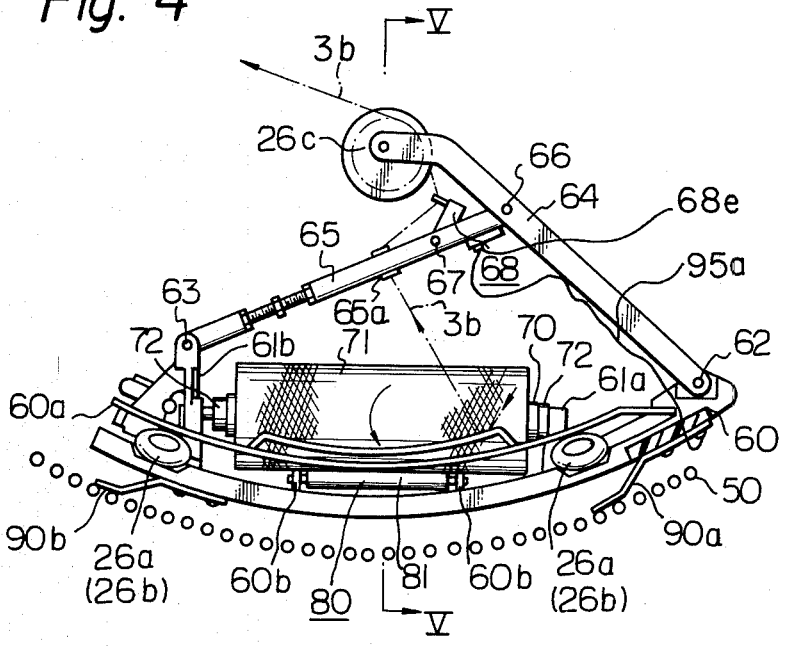
FIG. 4 is a side view of a shuttle utilized for the circular loom illustrated in FIG. 1, wherein parts of the mechanism according to the present invention are mounted.
Figure 5:
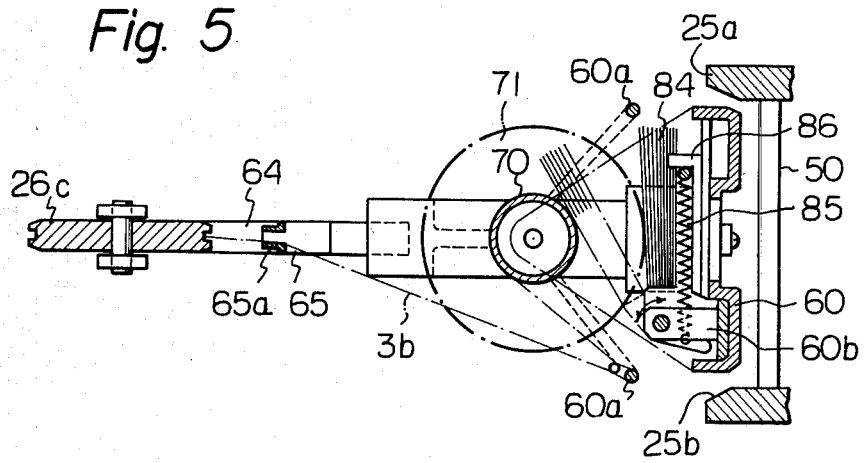
FIG. 5 is a schematic front view of the shuttle partly sectional view taken along the line V—V in FIG. 4.

Referring to FIGS. 4 and 5, the shuttle 26 comprises a frame shoe 60 provided with a pair of brackets 61*a*, 61*b* projected upward from the shoe 60, a pair of guide wires 60*a* extending along the longitudinal direction of the frame shoe 60 at both sides thereof and spaced a uniform distance from the shoe 60, a lever 64 pivoted on the top end portion of the frame shoe 60 by a pivot pin 62, an adjustable lever 65 pivoted on a top end portion of the bracket 61*b* by a pivot pin 63 and connected to the lever 64 by a pivot pin 66. To hold a yarn package 71 formed on a bobbin 70 by the shuttle 26, a pair of gripping members 72 are mounted on the brackets 61*a*, 61*b*, respectively. One of gripping members 72 is capable of displacing into the bracket 61*b* but is always urged toward the bracket 61*a* by means of an expansion helical spring (not shown) disposed between the bracket 61*b* and the gripping member 72. The wheel 26*c* is rotatably mounted on the free end portion of the lever 64.

Figure 6:
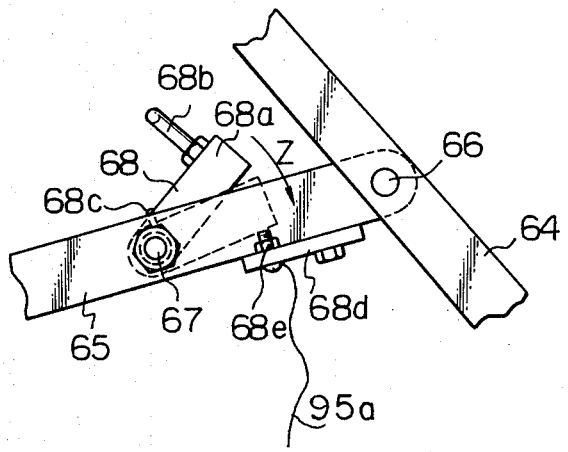
FIG. 6 is a schematic side view of a first detector for detecting the breakage of weft, mounted on the shuttle illustrated in FIG. 4.

In the above-mentioned shuttle 26, a yarn guide aperture 65*a* is formed on the lever 65 and, referring to FIG. 6, a main body 68*a* of a first detector 68 is turnably mounted on the lever 65 by a pin 67. The detector 68 is provided with a yarn guide 68*b* projected upward from the main body 68*a*. The detector 68 is further provided with a helical spring 68*c* mounted on the pin 67 by which the main body 68*a* of the detector 68 is always provided with a turning force toward the arrow Z in FIG. 6. On the other hand, the lever 65 is provided with a stopper 68*d*, which is an element of the first detector 68, and the stopper 68*d* is secured to the lever 65 at a position where a stop pin 68*e* of the stopper 68*d* restricts the turning motion of the main body 68*a* toward the arrow Z. The main body of the stopper 68*d* is made of an insulation material, such as a polyorefine resin, while the pin 68*e* is made of steel wire, and the other elements of the shuttle 26, including the main body 68*a* of the first detector 68, are made of an electrically conductive metal.

Referring again to FIGS. 4, 5 and 6, the above-mentioned embodiment, the weft 3*b* taken from the yarn package 71 firstly passes over the guide wire 60*a*, then, through the yarn guide opening 65*a* and, then, through the yarn guide 68*a* of the first detector 68, after which it is out from the shuttle 26 via the guide wheel 26*c*. In the normal weaving operation, since the yarn 3*b* is always pulled toward the taking out direction indicated by arrows in FIG. 4, a pertinent tension is imparted to the yarn 3*b*. Consequently, the main body 68*a* of the first detector 68 is always positioned at a position represented by a solid line in FIG. 6, so that main body 68*a* of the first detector 68 cannot contact the pin 68*e*. However, when the weft 3*b* is broken, since the yarn tension of the weft 3*b* becomes zero, the main body 68*a* of the first detector 68 turns toward the pin 68*e*, so that the main body 68*a* of the first detector 68 contacts the pin 68*e*. Therefore, the first detector 68 can be utilized as an on-off switch connection which is utilized as a part of an electric circuit of an electric stop motion mechanism of the circular loom which will be explained later.

As to a modification of the above-mentioned first detector 68, it is possible to utilize a so-called limit switch. In this case, the function of the elements 68*a* can be created by a feeler of the limit switch.

Figure 7:
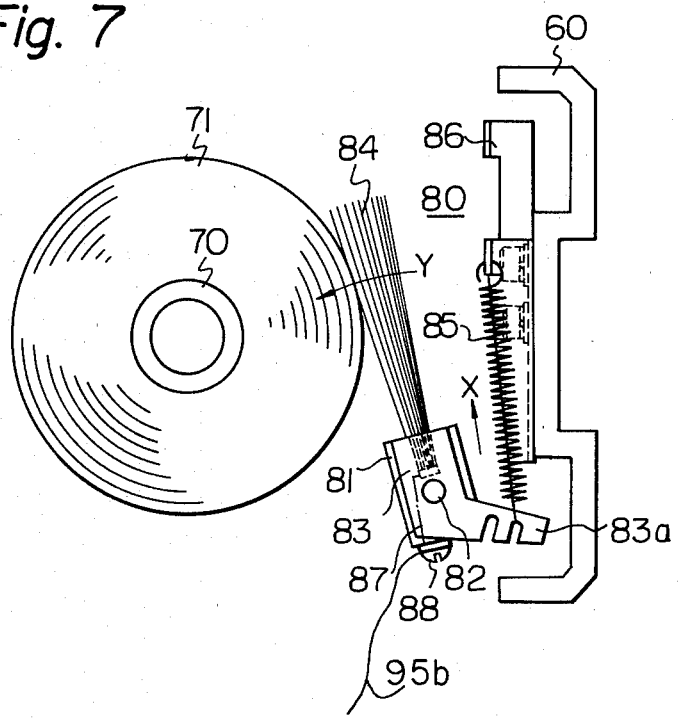
FIG. 7 is a schematic front view of a second detector for detecting an exhausted yarn package mounted on a shuttle according to the present invention.

Referring to FIGS. 5 and 7, which disclose an embodiment of the second detector according to the present invention, the second detector 80 (also indicated in FIG. 4) comprises a brush holder 81 turnably mounted on a pair of brackets 60*b* (FIG. 4) projected upward from the frame shoe 60 at a position between the brackets 61*a* and 61*b* by means of a pin 82, respectively, an auxiliary arm 83 (FIG. 7) secured to the brush holder 81 in such a manner that the arm 83 is also capable of turning about the pin 82, a plurality of brushes 84 secured at their one end to the brush holder 81, a spring 85 secured at one end thereof to a free end 83*a* of the auxiliary arm 83 secured at the other end thereof to a tension adjustable member 86 which is displaceably fixed to the frame shoe 60. At least one brush 84 is made of an electrically conductive material and the brush holder 81 is made of an insulation material, such as a plastic resin. The brushes 84 made of an electrically conductive material are electrically connected to a terminal 88 secured to the brush holder 81 by means of a conductive wire 87. In the above-mentioned construction, since the spring 85 always pulls the free and 83*a* of the auxiliary arm toward the direction represented by an arrow X in FIG. 7, the brushes 84 are always urged toward the yarn package 71 in the direction represented by an arrow Y. In this embodiment, the bobbin 70 is made of an electrically conductive material. Therefore, when the size of the yarn package 71 has decreased to a condition which occurs just before the exhaustion of the yarn wound on the bobbin 70, even if some surface portions of the bobbin 70 are still covered with yarn, it is possible to contact the surface portion of the bobbin 70 with the brushes 84 having the electrical conductive property. In other words, the second detector 80 can be utilized as an on-off switch connection which is utilized as a part of an electric circuit of an electric stop motion mechanism of the circular loom, like the first detector 68. A preferred embodiment regarding means for transmitting a signal issued from the abovementioned first and second detector 68, 80 is hereinafter explained with reference to FIGS. 2, 3, 4, 6, 7 and 8. As it can be easily understood from the disclosures shown by FIGS. 3 and 4, each shuttle 26 travels along the circular passage defined by the annular guide means 25 comprising a pair of annular guide members 25*a* and 25*b*. The vertical rods 50 are arranged concentrically to the annular guide means 25 at an outside adjacent position 100 to the guide means 25.

Figure 8:
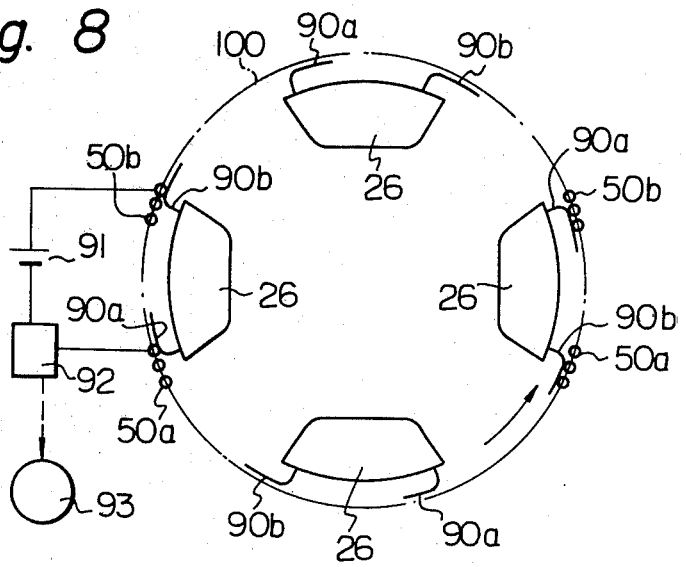
FIG. 8 is a schematic plan view of the mechanism according to the present invention, which indicates an electric connection between members of the mechanism according to the present invention.

A pair of sliders 90*a* and 90*b*, which are made of a material having electric conductive property, are secured to the shuttle with a pertinent interval therebetween in such positions where, when the shuttle 26 travel along the above-mentioned the circular passage thereof, the sliders 90*a*, and 90*b* are capable of sliding over the vertical rods 50. To prevent unexpected abrasion of the vertical rods 50 due to the frictional contact of the sliders 90*a*, 90*b* thereto, it is preferable to use a resiliently flexible material for making the sliders 90*a*, 90*b*. As shown in FIG. 8, the vertical rods 50 are divided into four successive groups which occupy symmetrical positions with respect to the axial center of the shaft 14 (FIG. 2) of the circular loom, and in each group of the vertical rods 50, a pair of plural vertical rods 50 are insulated from the annular guide means 25. The positions of those two sub-groups of vertical rods 50 are chosen in such condition that the intervened space between those two sub-groups of the vertical rods 50 is identical to the intervened space between the sliders 90*a* and 90*b*. In FIG. 6, those vertical rods 50 of the above-mentioned sub-groups in each symmetrical group of the vertical rods 50 are represented by 50*a*, 50*b*, respectively. Accordingly, in the region of each group of vertical rods 50, when the slider 90*a* contacts the vertical rod 50*a* of a group of the vertical rods 50, the slider 90*b* simultaneously contacts the corresponding vertical rod 50*b* of the same group of the rods 50.

In the shuttle 26 illustrated in FIG. 4, a connecting wire 95*a* connects the stop pin, which corresponds to the stop pin 68*e* shown in FIG. 6, of the first detector 68 to the slider 90*a*, while another connecting wire 95*b* connects the terminal, which corresponds to the terminal 88 shown in FIG. 7, of the second detector 80, to the slider 90*a*. On the other hand, the rods 50*a*, 50*b* are insulated from the annular guide means 25 (FIGS. 2, 3) while being electrically connected to the above-mentioned stopping means by way of the respective of electrically conductive connecting wires. When the first detector 68 and/or the second detector 80 detect an abnormal condition of the warp 3*b* being taken out from the yarn package 71 of a shuttle 26, and also, when the slider 90*a*, 90*b* of the shuttle 26, wherein either one of the first and second detectors 68, 80 detects the abnormal condition of warp 3*b* being taken out from the yarn package 71 of the bobbin 70, firstly contact the vertical rods 50*a*, 50*b* of either one of the pairs of the vertical rods 50*a*, 50*b* as illustrated in FIG. 8, the signals issued from the first detector 68 and/or the second detector 80 can be transmitted to the stopping means for stopping the supply of electric power to the driving motor 93 (the driving motor 5 in FIG. 1) of the circuit loom illustrated in FIG. 1.

Figure 9:
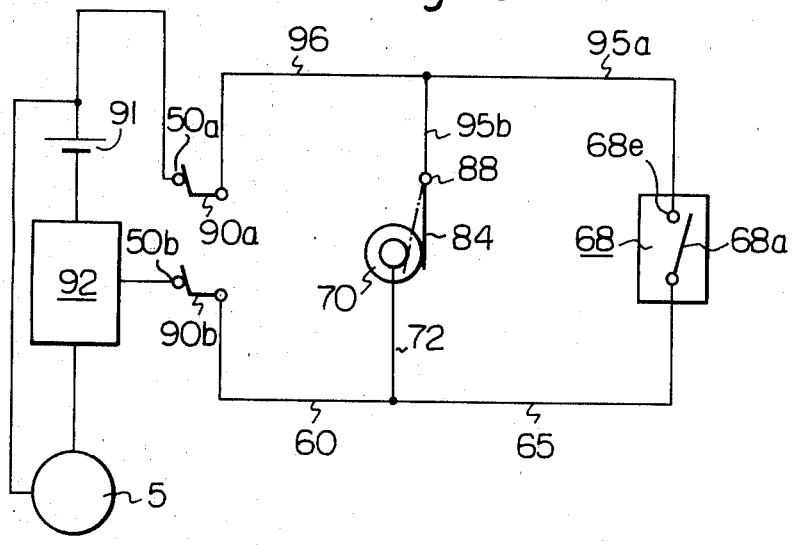
FIG. 9 is a schematic electric diagram of the circuit utilized for the mechanism according to the present invention.

The above-mentioned electrical connections of the elements involved in the mechanism for stopping the circular loom are illustrated in FIG. 9. In the electric circuit illustrated in FIG. 9, a part of the connecting wire which connects the stop pin 68*e* of the first detector 68 to the slider 90*a* is denoted as 95*a*, while a part of the connecting wire which connects the terminal 88 of the second detector 80 to the slider 90*a* is denoted as 95*b*, and the connecting wires 95*a* and 95*b* are connected to a connecting wire 96 which is connected to the slider 90*a*. On the other hand, the main body 68*a* of the first detector 68 is electrically connected to the lever 65 which is a part of the shuttle 26, while the bobbin 70 made of an electrically conductive material is electrically connected to the gripping member 72 of the shuttle 26, and the lever 65 and the gripping member 72 are electrically connected to the slider 90*b* by way of the frame shoe 60. Therefore, the first detector 68 and the second detector 80 provide the function of on-off switches applied in parallel condition to an electric circuit connecting the slider 90*a* to the brush 90*b*.

As the stopping means for stopping the supply of electric power to the driving motor 5 (FIG. 1) of the circular loom, a conventional magnetic relay can be effectively utilized. That is, as shown in FIG. 9, an input of a conventional magnetic relay 92 is connected to the terminal of either one of a pair of the vertical rods 50*a* and 50*b* via an electric power source 91 and another input of the magnetic relay 92 is directly connected to the vertical rods 50*b* which correspond to the above-mentioned terminal of the vertical rods 50*a*; while the motor 5 is connected to the electric power source 91 via a relay mechanism (not shown) of the magnetic relay 92 which is controlled by the condition of the above-mentioned on-off switches, that is the first and second detectors 68, 80, applied to the electric circuit connecting the brush 50*a* to the brush 50*b*. Therefore, when either one of the above-mentioned on-off switches is closed, that is, when either one of the first and second detectors 68, 80 issues a signal, the connection between the electric power source 91 and the motor 5 is interrupted by the action of the magnetic relay 92. In the above-mentioned embodiment, a bobbin 71 made of an electrically conductive material is utilized. However, if it is necessary to use a plastic bobbin, a thin sheet of metal, such as aluminum foil, can be used to cover the plastic bobbin, so as to create the same function as the bobbin 71, as an member having electric conductivity. It should be understood that any modification of the above-mentioned embodiment within the spirit of the present invention, for example, the omittion of either one of the first and second detectors 68, 80 utilization of only one pair of vertical rods 50*a* 50*b* etc is within the scope of the present invention.

I claim:

1. A mechanism for automatically stopping a weaving operation of a circular loom provided with at least one shuttle made of an electrically conductive metal and travelling along a circular passage defined by an annular guide means mounted on a frame of said circular loom and a motor for driving said circular loom, comprising:

a frame shoe secured to said shuttle;

means disposed in said shuttle for detecting an abnormal condition of a weft taken out from a yarn package formed on a bobbin held by said shuttle;

means for stopping the supply of electric power from an electric power source to said driving motor; and means for transmitting a signal issued from said detecting means to said stopping means when said detecting means of said shuttle detects an abnormal condition of the weft, said signal transmitting means comprising a first slider mounted on said bottom surface of said frame shoe by way of an insulation member, a second slider rigidly mounted on said bottom surface of said frame shoe and spaced apart from said first slider, said first and second sliders being made of an electrically conductive material, said first slider being connected to an output of said detecting means, at least one pair of stationary electric terminal members arranged at a position adjacent to the outside of said circular travelling passage of said shuttle, said sliders extending outwardly from said bottom surface of said frame shoe in such a condition that they are capable of contacting respective ones of said electric terminal members when said shuttle travels along said circular passage, and an electric connection between said terminal members and said stopping means.

2. A mechanism for automatically stopping a circular loom according to claim 1, wherein said detecting means comprises a first detector comprising an electrically conductive member rotatably mounted on a part of said shuttle, and an electrical insulation member mounted on a part of said shuttle at a position facing said electrically conductive member, an electrically conductive pin secured to said insulation member in such a condition that said pin is capable of contacting said electrically conductive member when said member is turned, a resilient spring for urging said electrically conductive member toward said electrically conductive pin, said electrically conductive member being provided with a yarn guide for guiding a weft taken out from a yarn package formed on a bobbin held by said shuttle.

3. A mechanism for automatically stopping a weaving operation of a circular loom provided with at least one shuttle made of an electrically conductive metal and travelling along a circular passage defined by an annular guide means mounted on a frame of said circular loom and a motor for driving said circular loom, comprising:

a frame shoe secured to said shuttle, and a pair of first brackets projected upward from said frame shoe, each of said first brackets being provided with a gripping member for rotatably supporting a bobbin having an electrically conductive surface portion;

means disposed in said shuttle for detecting an abnormal condition of a weft taken out from a yarn package formed on a bobbin held by said shuttle, said detecting means comprising a pair of second brackets rigidly mounted on said frame shoe at respective positions facing the corresponding gripping member, an electrical insulation member rotatably supported by said second brackets, an auxiliary member rigidly connected to an end of said insulation member, a resilient spring connected to one end of said auxiliary member, a free end of said spring connected to said frame shoe so that said insulation member is always provided with a turning force toward said bobbin, a plurality of brushes mounted on said insulation member, said brushes being provided with such length that all of said brushes are capable of contacting the electrically conductive surface portion of said bobbin when said insulation member turns, at least one of said brushes being made of an electrically conductive member, and an electric terminal mounted on said insulation member in such a condition that it is connected to said brush made of an electrically conductive material;

means for stopping the supply of electric power from an electric power source to said driving motor; and means for transmitting a signal issued from said detecting means to said stopping means when said detecting means of said shuttle detects an abnormal condition of the weft.

4. A mechanism for automatically stopping a weaving operation of a circular loom provided with at least one shuttle made of an electrically conductive metal and travelling along a circular passage defined by an annular guide means mounted on a frame of said circular loom and a motor for driving said circular loom, comprising:

a frame shoe secured to said shuttle, and a pair of first brackets projected upward from said frame shoe, each of said first brackets being provided with a gripping member for rotatably supporting a bobbin having an electrically conductive portion;

means disposed in said shuttle for detecting an abnormal condition of a weft taken out from a yarn package formed on a bobbin held by said shuttle, said detecting means comprising a first detector and a second detector, said first detector comprising an electrically conductive member rotatably mounted on a part of said shuttle, and an electrical insulation member mounted on a part of said shuttle at a position facing said electrically conductive member, an electrically conductive pin secured to said insulation member in such a condition that said pin is capable of contacting said electrically conductive member when said electrically conductive member is turned, a resilient spring for urging said electrically conductive member toward said electrically conductive pin, said electrically conductive member being provided with a yarn guide for guiding a weft taken out from a yarn package formed on a bobbin held by said shuttle, said second detector comprising a pair of second brackets rigidly mounted on said frame show at respective positions facing the corresponding gripping members, an electrical insulation member rotatably supported by said second brackets, an auxiliary member rigidly connected to an end of said insulation member, a resilient spring connected to said auxiliary member, a free end of said spring being connected to said frame shoe so that said insulation member is always provided with a turning force toward said bobbin, a plurality of brushes mounted on said insulation member, said brushes being provided with such length that all of said brushes are capable of being in contact with the electrically conductive surface portion of said bobbin when said insulation member turns, at least one of said brushes being made of an electrically conductive material, an electric terminal mounted on said insulation member in such a condition that it is connected to said brush made of an electrically conductive material;

means for stopping the supply of electric power from an electric power source to said driving motor; and means for transmitting a signal issued from said detecting means to said stopping means when said detecting means of said shuttle detects an abnormal condition of the weft.

* * * * *